United States Patent [19]

Spaccarotella

[11] 4,311,186

[45] Jan. 19, 1982

[54] METHOD FOR QUICKLY REPAIRING BREAK-OUTS IN CONTINUOUS CASTING PLANTS

[76] Inventor: Antonio Spaccarotella, Via Como No 6, Roma, Italy

[21] Appl. No.: 188,533

[22] Filed: Sep. 18, 1980

[51] Int. Cl.[3] ..... B22D 11/10; B22D 11/16

[52] U.S. Cl. ..... 164/453; 164/473

[58] Field of Search ..... 164/57, 58, 55, 56, 164/86, 82, 4

[56] References Cited

U.S. PATENT DOCUMENTS

| | | | |
|---|---|---|---|
| 3,786,856 | 1/1974 | Nishikawa | 164/82 X |
| 3,789,911 | 2/1974 | Bachner | 164/82 |
| 3,834,445 | 9/1974 | Raschke | 164/82 X |
| 3,891,023 | 6/1975 | Szekeres | 164/55 |
| 4,250,945 | 2/1981 | Koshikawa et al. | 164/86 |
| 4,269,257 | 5/1981 | Ohzu et al. | 164/86 |

FOREIGN PATENT DOCUMENTS

| | | | |
|---|---|---|---|
| 751294 | 1/1967 | Canada | 164/58 |
| 2321847 | 11/1974 | Fed. Rep. of Germany | 164/57 |

*Primary Examiner*—Robert D. Baldwin
*Assistant Examiner*—J. Reed Batten, Jr.
*Attorney, Agent, or Firm*—Young & Thompson

[57] ABSTRACT

In a continuous casting plant, the ingot leaves the mold in a downward direction with only a thin skin of solidified metal, the metal within the solidified skin remaining molten until it progressively solidifies. While the skin is still thin, "break-out" can occur, that is, a rupture of the skin with subsequent outflow of the molten metal. When this happens, according to the present invention, the flow of liquid metal into the mold is interrupted and cooling powders are added to the mold, having a particle size of 0.1–5 mm, at a rate of 5 to 100 kg/min. After 0.1 to 5 minutes, the flow of liquid metal to the mold can be resumed.

5 Claims, 1 Drawing Figure

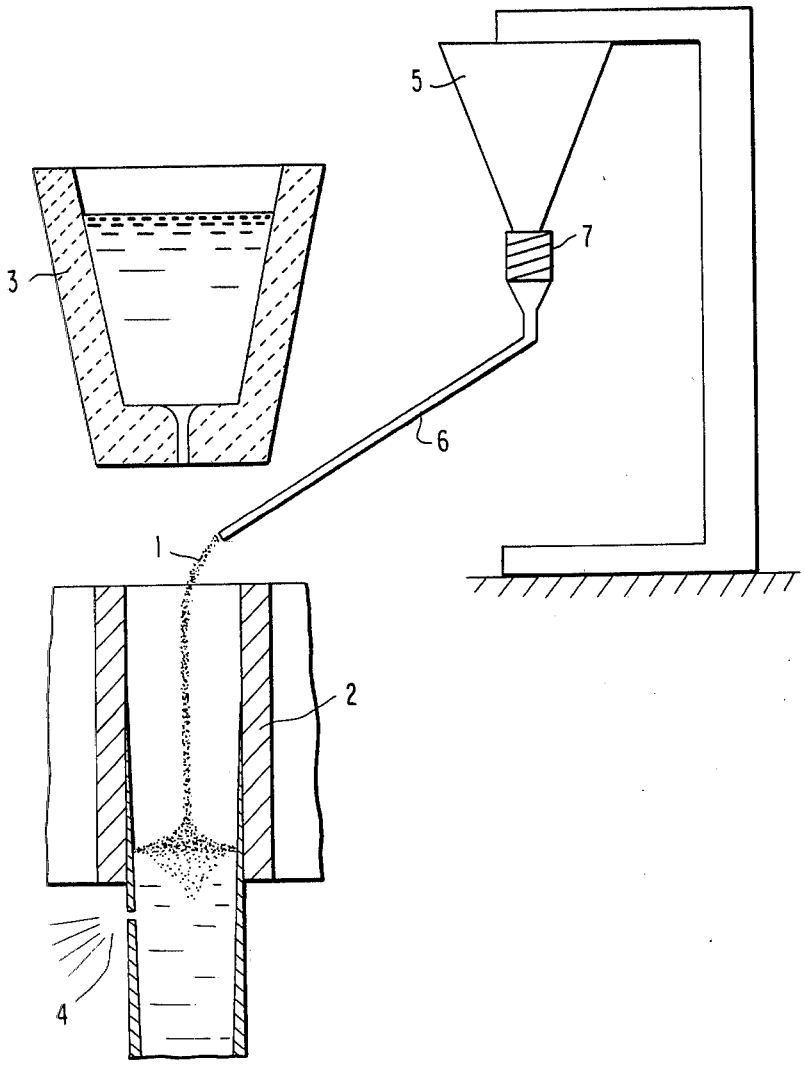
5
7
3
6
1
2
4

METHOD FOR QUICKLY REPAIRING BREAK-OUTS IN CONTINUOUS CASTING PLANTS

The present invention relates to a method for quickly repairing break-outs that occur in the course of continuous casting, namely, the breaking of the solidified skin of a continuously cast ingot as it leaves a continuous casting mold.

As is known, break-outs are caused by insufficient cooling and/or the presence of slag occlusions in the solidified skin. When this happens, there is a sudden fall in the level of molten metal in the mold and an outflow of liquid metal from the crack produced in the surface of the ingot that is being withdrawn from the mold.

In conventional continuous casting technology, one tundish distributes the molten metal it receives from the ladle to several casting lines. Hence, when break-out occurs, it is necessary to isolate that line. As will be readily appreciated, the exclusion of a line results in lengthening the casting time of the whole plant, and so has unforeseeable effects on the quality of the steel, because of greater exposure to the air and the greater amount of cooling.

According to the present invention, break-out at the outlet end of the mold can be quickly repaired, by the addition of metal powders to the mold, using appropriate techniques and an appropriate particle size. The injection of such powders into the mold enables the operation of the line to be quickly restarted, because a layer of solid metal is formed, thus preventing any further outflow of molten metal from the crack or cracks which open in the solidified skin.

More particularly, the method according to the present invention comprises in combination the following operations:

1. Interrupting the flow of liquid metal to the line affected by the break-out;
2. Adding to the mold in question, cooling metal powders having a grain size between 0.1 and 5 mm at a rate between 5 and 100 kg/min.; and
3. Restarting the line after a time between 0.1 and 5 minutes.

The metal powder added to the mold should preferably melt at a higher temperature than the metal being cast. In the case of continuous casting of steel, good results are obtained when steel powders containing as much iron as possible are used. Of course, the quantity of powder to be added for the purposes of the present invention varies as the cross-sectional area of the mold involved.

In the period between the occurrence of the break-out and the restarting of the line, the flow of metal can be simply diverted instead of being stopped; and the term "interrupted" as used herein covers both possibilities.

The invention is especially effective in the case of continuous casting plants in which the dimensions of the bar produced are not great and the flow rate of metal being cast is not high.

The drawing shows somewhat schematically an embodiment of apparatus for practicing the method according to the present invention. The drawing is a side elevational view of the cooling powder feeding device and the longitudinal sections of a tundish and a mold in a continuous casting plant for steel.

In the drawing, powder 1 which is the cooling metal powder in question, is fed to continuous casting mold 2 after the flow of steel from tundish 3 has been interrupted because of the occurrence of a break-out at point 4. The powder 1 is fed from hopper 5 through pipe 6 by means of a helical screw feeder shown diagrammatically at 7.

The powder that reaches the mold melts endothermically, thus causing rapid cooling of the steel and hence rapid solidification of the outermost layers, thereby effectively sealing the crack or cracks in the skin of the bar which is the ingot emerging from the lower end of the continuous casting mold.

For purposes of further disclosing the invention, the following non-limiting illustrative example is given:

EXAMPLE

An open-type continuous casting plant for the production of bar for concrete reinforcement and for drawing, is of the curved ingot type with a productive capacity of 180 tons per heat. It produces billets whose cross section is 140×140 mm, on each of eight casting lines fed from a single tundish. The operating speed is 2 m per minute and the flow of steel is 304 Kg per minute per line.

In this example, a comparison is made of the various consequences of a break-out on the skin of the bar just below the mold of one of the lines, due to a deposit of slag inclusions in the skin, first in the case in which the method of the present invention is not practiced, and second in the case in which the method of the present invention is applied. In the former or prior art case, when break-out occurs, it is necessary to stop the flow of steel to the damaged line for the whole of the remaining casting period, with the result that the entire cycle takes 12 minutes more than the time of operation normally required.

But operating according to the present invention, instead, the flow of steel to the mold of the line where the break-out occurred is immediately diverted. Then, spherical grains of carbon steel of a size range between 0.5 and 1.5 mm are added to the mold at a rate of 20 Kg/min. Addition of the particles of carbon steel begins immediately the flow of steel to the mold ceases, and continues for 30 seconds, for a total addition of 10 Kg. Following the addition, there is a pause of 30 seconds and then the feed of steel to the line is started again. The whole casting cycle has been delayed by only one minute, which of course is a time 12 times less than in the first case, when the present invention was not applied.

The casting steel had a melting point of 1490° C. and a weight percent composition as follows: C 0.4, Mn 0.8, Si 0.2, S 0.03, P 0.03, balance essentially iron.

The spherical grains of carbon steel added as cooling powder had a melting point of 1450° C. and the following weight percent composition: C 0.8, Mn 0.7, Si 0.6, S 0.015, P 0.015, balance essentially iron.

From a consideration of the foregoing disclosure, it will be evident that the initially recited object of the present invention has been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a method of continuously casting an ingot including supplying liquid metal from a pour vessel into continuous casting mold and withdrawing an ingot having a solidified skin from the mold; the improvement comprising the steps of detecting the occurrence of a break-out of liquid metal through a crack in the solidified skin of the ingot;

interrupting the flow of liquid metal to the mold;

adding to the liquid metal in the mold cooling metal powders having a grain size 0.1 mm to 5 mm at a rate of 5 to 100 Kg/min, the metal powders melting endothermically upon contact with the liquid metal and causing rapid cooling of the liquid metal to seal the crack in the solidified skin; and resuming the flow of liquid metal to the mold after a period of time between 0.1 minute and 5 minutes.

2. A method as claimed in claim 1, in which the cooling metal powder has a higher melting point than the metal being cast.

3. A method as claimed in claim 1, in which the metal being cast and the cooling metal powders are both steel.

4. A method as claimed in claim 1, in which the interrupted flow of liquid metal is diverted to another continuous casting mold.

5. A method as claimed in claim 1, in which a billet about 140 mm×140 mm is produced, at an operating speed of about 2 m/min, the metal cast and the cooling metal powders both being steel, the cooling metal powders having a particle size about 0.5 to 1.5 mm and being added at a rate of about 20 Kg/min, the flow of liquid metal to the mold being interrupted for about one minute.

* * * * *